US006719421B2

(12) United States Patent
Tyvoll

(10) Patent No.: US 6,719,421 B2
(45) Date of Patent: Apr. 13, 2004

(54) MODIFICATION OF INKS DURING PRINTING TO REDUCE COLOR INTENSITY

(75) Inventor: David Tyvoll, La Jolla, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/173,850

(22) Filed: Jun. 18, 2002

(65) Prior Publication Data

US 2003/0231233 A1 Dec. 18, 2003

(51) Int. Cl.[7] ..... B41J 2/01
(52) U.S. Cl. ..... 347/100; 347/96
(58) Field of Search ..... 347/100, 101, 347/96, 95, 98, 107; 106/31.13, 31.27

(56) References Cited

U.S. PATENT DOCUMENTS 6,336,721 B1 * 1/2002 Provost et al. ..... 347/100
6,498,222 B1 * 12/2002 Kitamura et al. ..... 347/100

* cited by examiner

*Primary Examiner*—Stephen D. Meier
*Assistant Examiner*—Manish Shah

(57) ABSTRACT

A method of printing with an ink-jet printer. The method includes printing a dye onto a substrate, printing a deactivating agent on the dye, causing the agent to react with either the dye or the substrate, and washing the substrate. The invention is also an ink-jet cartridge having a plurality of reservoirs, some of which contain an ink having a dye and at least one of which contains a deactivating agent.

35 Claims, No Drawings

MODIFICATION OF INKS DURING PRINTING TO REDUCE COLOR INTENSITY

FIELD OF THE INVENTION

This invention relates to modification of colorants during ink-jet printing, and, more specifically, to modification of colorants to reduce the intensity of the printed dye.

BACKGROUND OF THE INVENTION

Traditionally, textile manufacturers have printed designs onto fabrics using screening techniques. A series of flat or rotary screens are produced with a multitude of holes through which the ink can pass through the screen onto the fabric. A different screen is required for each color. Furthermore, to print more than one color, the screens must be perfectly registered with one another. Thus, complex patterns composed of many colors are difficult to produce. If it is desired to alter colors within a pattern, the ink used with a particular screen can simply be changed. If an alteration to the pattern itself is desired, however, the manufacturer must produce a whole new set of screens. This process is expensive and may take many weeks to complete.

As a result, many manufacturers are adapting ink-jet printing techniques to print designs onto various fabrics. Changing the pattern on the fabric is as simple as altering the design on a computer. A new sample with the revised design may be printed almost immediately. Traditional ink-jet printers for paper utilize four pens: cyan, yellow, magenta, and black. Two additional pens, light cyan and light magenta, are frequently used to improve tonal quality. Even greater tonal quality and color gamut are required for industrial fabrics. At least eight to twelve pens are typically used in these applications. For example, six or seven primary colors, including red, blue, orange, gold, and green may be used in addition to the four basic colors. Light pens, including light cyan, light magenta, light blue, and light red may also be employed. The light pens are required for producing pastels and other lighter colors. To produce a light color with a dark pen, full strength colors are printed in a dithering pattern. While an observer standing far away would observe the pastel color, on closer observation, the customer would see the individual pixels of color instead of the overall design. Thus, light color inks are necessary to produce light color fabrics. However, ink-jet pens are relatively expensive, and the use of a large number of pens increases printing costs dramatically. As a result, it is desirable to have a printing method that can produce a range of color intensities with a minimal number of pens.

SUMMARY OF THE INVENTION

In one aspect, the invention is a method of printing with an ink-jet printer. A colorant and a deactivating agent are printed onto a substrate. The agent is caused to react with either the substrate or the colorant, and the substrate is washed.

DETAILED DESCRIPTION

Different types of colorants are used to print on different types of fabrics. Two broad classes of colorants are used, dyes and pigments. Dyes, which are typically charged, may be further divided into classes that are used to print on specific fabric types. Some common examples of these are discussed below. Pigments, on the other hand, are microscopic colorant particles that are usually dispersed with polymers. By virtue of their polymeric dispersant, pigments may be applied to most substrate types. Most colorants are printed on the fabric and heated, typically with steam. The steam increases the mobility of the colorant within the material, which disperses the colorant more evenly in the fabric. This reduces pixellation of the colorant on the fabric. However, if the material is steamed too long, the colorant diffuses too much and the edges of the pattern become fuzzy, especially if the colorant is a dye. Thus, proper steaming conditions are required to produce high quality images. Following heating, the fabric is washed to remove excess colorant.

Acid dyes are typically used to print patterns on silk and wool. These dyes may also be used on polyamides such as nylon. Silk and wool are primarily composed of keratin, the major component of hair and skin. Acid dyes are composed of aromatic and fused aromatic rings with carboxylate and sulfonate substituents. Following printing, high temperature steaming disrupts the secondary and tertiary structure of the keratin. As the fabric is cooled, the keratin reforms the non-covalent bonds, which originally maintained the secondary and tertiary structure of the protein, with the dyes. The large number of hydrogen, ionic, hydrophobic, and aromatic ($\pi$) bonds that are formed between the amino acids in the material and various atoms and structures in the dye molecules strongly retain the dye within the material. For example, aromatic amino acids form $\pi$-bond networks with the aromatic rings of the acid dyes. Due to the non-covalent nature of the bonds, these materials should not be cleaned in hot water or the dye can be released.

Pure synthetic fabrics such as nylon and rayon may also be patterned with disperse dyes. The dye is printed onto these polymeric fabrics, which are then heated in excess of their glass transition temperatures ($T_g$). The high temperatures both soften the polymer fabric and increase the diffusivity of the dye within the polymers. The dye penetrates into the fabric and remains there once the fabrics are cooled.

Practically any fabric may be colored with a pigment. However, pigments are typically confined to applications where the consumer is not concerned with the hand, or feel, of the fabric. Pigments also result in a less lustrous printed pattern than other colorants. They are typically used for automobile upholstery, carpeting, airplane seats, and inexpensive curtains. A resin is also applied with the pigment; subsequent to printing, heat curing is used to form a film which provides durability to the pattern.

Reactive dyes are typically used for printing on cotton or cotton/synthetic blends, such as cotton/polyester blends. Cotton is composed of cellulose, the primary component of plants. Prior to printing, multiple chemical pretreatment steps of the fabric may be used. Common to these methods is the treatment with base, which forms reactive alkoxides on the cellulose. Typical reactive dyes utilize a monochlorotriazine moiety. The dye is printed on the fabric, which is then steamed. The steam provides energy for the alkoxide on the deprotonated cellulose to substitute for the chlorine atom on the dye via nucleophilic addition (of the alkoxide) and elimination (of the chloride) to form an ether linkage, as shown below. Because the dye is covalently bound to the fabric, these fabrics can be washed in warm or hot water without separating the dye from the fabric.

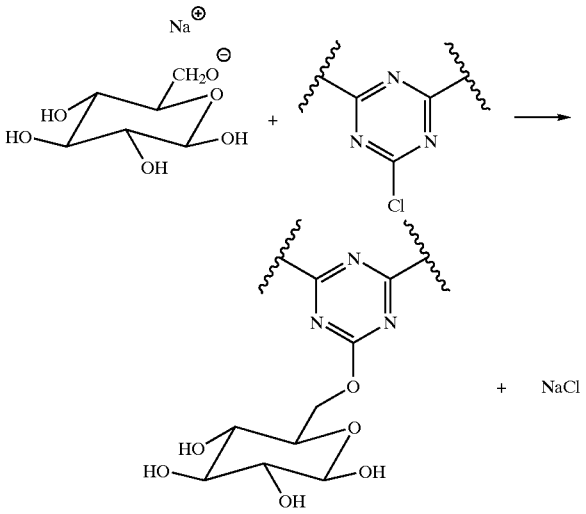

The invention exploits the realization that dark pens can be used to print lighter colors if a portion of the ink deposited on the fabric is not allowed to penetrate or react with the material. For example, if a hydrolyzing agent is overprinted on a reactive dye, the agent will compete with the cellulose in the fabric when the material is steamed. Any dye that reacts with the hydrolyzing agent instead of with the fabric will have a hydroxyl group attached to the triazine instead of a chlorine atom, as shown below. The hydroxyl group is not a good leaving group, and the dye will not be able to react with the cellulose but will be washed off following steaming.

The hydrolyzing pen obviates the use of light colored ink pens for

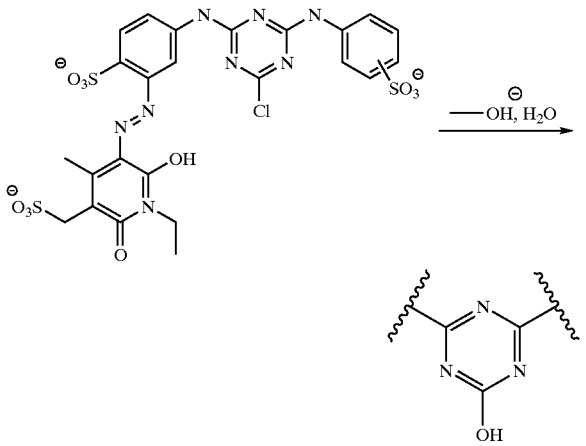

printing. Alternatively, the light colored ink pens may be replaced with different colors, such as purple, navy, silver, or brown. In another embodiment, the invention also facilitates higher quality printing of monochrome patterns. A printer with a range of, e.g., blue pens, ranging from dark to light, might be employed to print a pattern. Use of a hydrolyzing pen will increase the continuity of the range of colors that can be achieved with the pens, reducing pixellation of printed patterns.

Hydrolyzing agents appropriate for use with the invention include sodium hydroxide, potassium hydroxide, and other metal hydroxide salts. In general, any hydrolysis agent that can compete effectively with the cellulose alkoxide may be used. Different agents may be selected depending on the temperature required for hydrolysis of the dye, which may range from room temperature to 100° C. or higher.

The hydrolyzing agent is only one of a variety of deactivating agents that may be employed. Alternative deactivating agents may also compete effectively with the cellulose by reacting with the dye to render it largely unreactive towards the cellulose. Exemplary deactivating agents include alkyl thiolates, various amines, alkoxide salts, azides, and other nucleophiles.

An alternative strategy is to employ a deactivating agent to react with base-treated cellulose in order to render it unreactive towards the reactive dye. For example, an acid solution would convert some fraction of alkoxide in the cellulose to less reactive hydroxyl groups. In a similar fashion, solutions of electrophiles can be used to deactivate these types of substrates.

This strategy can also be extended to other types of textile colorants, which do not require formation of a covalent bond to the substrate. In one embodiment, one or more chemical moieties may be attached to a dye or pigment dispersion before loading it in a printing cartridge. The colorant is printed on the fabric, followed by a deactivating agent. The deactivating agent chemically modifies the moiety to render the colorant more soluble in water. When the material is steamed or washed, the solubilized colorant rinses out. For example, an acid dye's solubility can be altered such that its removal during washing can be enhanced. In this case a reactive reagent is used not to disrupt covalent bond formation between the dye and the substrate, but to modify the dye itself. One way to accomplish this is by modifying the dye with a sufficiently labile alkyl ester. This ester can be subsequently cleaved by a base, yielding a more soluble carboxylate group on the dye. In another example, introducing alternative counterions onto the printed pixel can enhance the dye's solubility. For typical colorants, lithium and various alkyl ammonium salts are usually more soluble than sodium salts.

A complementary method would be to reduce the affinity of the dye for the fiber. Non-reactive reagents that do not involve formation of covalent bonds may be used as well. Other exemplary reagent classes include surfactants. These may be used as penetrants, in which case the dye is carried so far into the interior of the fiber that its effective color strength is reduced. Alternatively, they may be employed as detergents that enhance the dye's solubility during the washing steps. Appropriate surfactants include those commonly used in ink vehicles and should be optimized with respect to the chemical properties of the ink, the substrate, or both.

The deactivating agent is mixed with a liquid vehicle and deposited into the reservoir of a pen. The pen may be part of a separate cartridge or may be included with colored pens in a single cartridge. Alternatively, each color pen may be paired with a hydrolyzing pen in an individual cartridge. Typical ink vehicles include a humectant, various surfactants, corrosion inhibitors, polymers and a biocide. A humectant forms hydrogen bonds with water in the vehicle to decrease evaporation during storage and to maintain colorant or ink vehicle component solubility during drop formation on the print head. Typical humectants include diols, triols, polyols, and various heavy alcohols. Suitable diols include ethanediols, propanediols, butanediols, hexanediols, heptanediols, and octanediols. Typical triols include propanetriols such as 2-ethyl-2-hydroxymethyl-1, 3-propanediol and ethylhydroxypropanediol. Glycol ethers, thioglycol ethers, polyalkylene glycols (e.g., diethylene glycol, diporpylene glycol, PEG 200 and larger polymeric glycols) may be also employed. An anti-cockle reagent prevents buckling of the substrate as it is wet by the ink and may be useful for thinner fabrics such as silk. A variety of biocides suitable for inkjet printing are well known in the art and include NUOSEPT™ (Hals America), PROXEL™ GXL (Avecia, Inc.), and glutaraldehyde. Polymers for inkjet printing include polyethylene imine, for example, LIPOSOL™ G (MW~700), available from BASF.

Appropriate surfactants depend on the desired interaction between the dye and the fabric. One skilled in the art will be able to choose an appropriate surfactant for the particular printing application. For example, cationic, nonionic, or zwitterionic dyes are preferred for positively charged disperse dyes and pigments. Typical cationic surfactants include betaines, quaternary ammonium compounds, cationic amine oxides, and imidazoline surfactants. Typical non-ionic surfactants include secondary alcohol ethoxylates, nonionic fluoro surfactants, non-ionic fatty acid ethoxylate surfactants, and acetylenic polyethylene oxide surfactants. Anionic, non-ionic, or zwitterionic surfactants are preferred for negatively charged acid and reactive dyes. Typical anionic surfactants include alkyldiphenyloxide surfactants and fluorinated surfactants. Appropriate surfactants are well known to those skilled in the art and are commonly available from chemical suppliers.

Because the invention relies on interaction competition between the deactivating agent and the colorant, the stoichiometry of the reaction should be carefully controlled. However, chemical reactions of small molecules are not 100% efficient. In addition, colorants react differently with materials having different compositions or even different sources. For example, cotton grown in Indonesia reacts differently with a given dye than cotton grown in Georgia. Because the deposition of the colorants is automated, the conditions for the reaction can be carefully controlled. By first printing a test swatch of material to calibrate the amount of deactivating agent required to form different shades, an operator can print a consistent pattern on a large amount of material. Because the color of the pattern changes after steaming, a test swatch of the final product should be used to perform the calibration. Colorimeters may be used to further automate the calibration process. Indeed, a manufacturer may wish to perform frequent calibrations to adjust the printing conditions for variations in humidity and temperature.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A method of printing with an inkjet printer, comprising:

printing a colorant onto a predetermined pixel on a substrate;

printing a deactivating agent on the pixel;

reacting the deactivating agent with at least one the colorant and the substrate such that at least a portion of the colorant is nonreactive with the substrate; and washing the substrate.

2. The method of claim 1, wherein printing a deactivating agent on the pixel comprises printing the deactivating agent before printing the colorant.

3. The method of claim 1, wherein printing a colorant onto a predetermined pixel on a substrate comprises printing the colorant on a fabric.

4. The method of claim 3, wherein printing the colorant on a fabric comprises printing the colorant on a substrate selected from the group consisting of a synthetic fiber, a natural fiber, and a mixture thereof.

5. The method of claim 1, further comprising calculating an amount of the deactivating agent to print, wherein the amount of the deactivating agent is calculated to react with a predetermined amount of the colorant or the substrate.

6. The method of claim 1, wherein reacting the deactivating agent with at least one of the colorant and the substrate comprises forming a non-covalent bond between the colorant and the deactivating agent.

7. The method of claim 1, wherein reacting the deactivating agent with at least one of the colorant and the substrate comprises heating the substrate.

8. The method of claim 7, wherein reacting the deactivating agent with at least one of the colorant and the substrate comprises heating the substrate with steam.

9. The method of claim 1, wherein printing a colorant onto a predetermined pixel on a substrate comprises printing a reactive dye on the substrate.

10. The method of claim 9, wherein printing a colorant onto a predetermined pixel on a substrate comprises printing the colorant on cotton.

11. The method of claim 9, wherein printing a deactivating agent on the pixel comprises printing the deactivating agent selected from the group consisting of an acid and an electrophile on the pixel.

12. The method of claim 9, wherein printing a deactivating agent on the pixel comprises printing the deactivating agent selected from the group consisting of a hydrolyzing agent, an alkylthiolate, an amine, an alkoxide salt, and an azide.

13. The method of claim 9, wherein printing a deactivating agent on the pixel comprises printing the deactivating agent selected from the group consisting of sodium hydroxide, potassium hydroxide, and metal hydroxides on the pixel.

14. The method of claim 9, wherein reacting the deactivating agent with at least one of the colorant and the substrate comprises reacting the deactivating agent with the colorant to attach a hydroxyl group to the colorant.

15. The method of claim 1, further comprising attaching a labile chemical group to the colorant before printing the colorant on the substrate.

16. The method of claim 15, wherein attaching a labile group to the colorant comprises attaching the labile group to the colorant via an ester linkage, and wherein printing a deactivating agent on the pixel comprises printing a base on the pixel.

17. The method of claim 1, wherein printing a deactivating agent on the pixel comprises printing the deactivating agent selected from the group consisting of a lithium salt and an alkyl ammonium salt on the pixel.

18. The method of claim 1, wherein printing a deactivating agent on the pixel comprises printing the deactivating agent selected from the group consisting of a surfactant and a detergent on the pixel.

19. A co-printing agent for modifying the color intensity of a printed ink, comprising:

a vehicle; and a deactivating agent formulated to react with at least one of a colorant of a printed ink and a substrate upon which the printed ink is printed such that at least a portion of the printed ink is nonreactive with the substrate.

20. The co-printing agent of claim 19, wherein the vehicle comprises a member selected from the group consisting of humectants, polymers, biocides, corrosion inhibitors, surfactants, and combinations thereof.

21. The co-printing agent of claim 19, wherein the deactivating agent comprises a hydrolyzing agent.

22. The co-printing agent of claim 19, wherein the deactivating agent is selected from the group consisting of sodium hydroxide, potassium hydroxide, and metal hydroxides.

23. The co-printing agent of claim 19, wherein the deactivating agent is selected from the group consisting of an acid and an electrophile.

24. The co-printing agent of claim 19, wherein the deactivating agent is selected from the group consisting of alkyl thiolates, alkoxide salts, azides, and substituted triazines.

25. The co-printing agent of claim 19, wherein the deactivating agent is selected from the group consisting of a base, a lithium salt, and an alkyl ammonium salt.

26. The co-printing agent of claim 19, wherein the deactivating agent is selected from the group consisting of a detergent and a surfactant.

27. An ink cartridge for use with an inkjet printer, comprising:

a plurality of reservoirs, each of which is in fluidic communication with a pen;

wherein:

a portion of the plurality of reservoirs comprises an ink comprising a dye, and at least one of the plurality of reservoirs comprises a deactivating agent formulated to react with at least one of the dye and a substrate upon which the printed ink is printed such that at least a portion of the printed ink is nonreactive with the substrate.

28. The ink cartridge of claim 27, wherein at least one of the dyes is a reactive dye and the deactivating agent is a hydrolyzing agent.

29. The ink cartridge of claim 28, wherein the hydrolyzing agent comprises a member selected from the group consisting of sodium hydroxide, potassium hydroxide, and metal hydroxides.

30. The ink cartridge of claim 27, wherein at least one of the dyes comprises a labile group, and wherein the deactivating agent is formulated to cleave the labile group from the dye.

31. The ink cartridge of claim 27, wherein the deactivating agent comprises a member selected from the group consisting of an acid and an electrophile.

32. The ink cartridge of claim 27, wherein the deactivating agent comprises a member selected from the group consisting of alkyl thiolates, alkoxide salts, azides, and substituted triazines.

33. The ink cartridge of claim 27, wherein the deactivating agent comprises a member selected from the group consisting of a detergent and a surfactant.

34. The ink cartridge of claim 27, wherein the deactivating agent modifies a member selected from the group consisting of the solubility and the penetrability of at least one of the dyes.

35. A co-printing agent for inkjet printing, comprising:

a vehicle; and a deactivating agent formulated to react with a colorant in an inkjet ink such that the colorant has an increased solubility in water.

* * * * *

UNITED STATES PATENT AND TRADEMARK OFFICE

CERTIFICATE OF CORRECTION

PATENT NO. : 6,719,421 B2
DATED : April 13, 2004
INVENTOR(S) : Tyvoll

It is certified that error appears in the above-identified patent and that said Letters Patent is hereby corrected as shown below:

Column 5,
Line 58, between “one” and “the”, insert -- of --.

Signed and Sealed this

Seventeenth Day of August, 2004

JON W. DUDAS
*Acting Director of the United States Patent and Trademark Office*